US009003931B2

(12) United States Patent
Phillips, Sr. et al.

(10) Patent No.: US 9,003,931 B2
(45) Date of Patent: Apr. 14, 2015

(54) REPLACEABLE JAW MEMBERS FOR PLIERS

(71) Applicant: Penn United Technologies, Inc., Cabot, PA (US)

(72) Inventors: Charles M. Phillips, Sr., Zelienople, PA (US); Mark P. Noah, Butler, PA (US)

(73) Assignee: Penn United Technologies, Inc., Cabot, PA (US)

( * ) Notice: Subject to any disclaimer, the term of this patent is extended or adjusted under 35 U.S.C. 154(b) by 277 days.

(21) Appl. No.: 13/629,830

(22) Filed: Sep. 28, 2012

(65) Prior Publication Data

US 2014/0090525 A1 Apr. 3, 2014

(51) Int. Cl.

*B25B 7/04* (2006.01)
*B25B 7/10* (2006.01)
*B25B 7/12* (2006.01)

(52) U.S. Cl.

CPC ... *B25B 7/04* (2013.01); *B25B 7/10* (2013.01); *B25B 7/12* (2013.01)

(58) Field of Classification Search

CPC ..... B25B 7/10; B25B 7/12; B25B 7/04; B25B 7/14

USPC ..... 81/423, 421, 355, 357, 358, 359, 337, 81/338, 391, 407, 411, 387

See application file for complete search history.

(56) References Cited

U.S. PATENT DOCUMENTS

| | | | | | |
|---|---|---|---|---|---|
| 1,556,755 | A | * | 10/1925 | Burman | 81/423 |
| 3,534,641 | A | * | 10/1970 | Le | 81/357 |
| 4,438,669 | A | | 3/1984 | Hastings | |
| 4,499,798 | A | * | 2/1985 | Miskiewicz | 81/423 |
| 4,813,310 | A | | 3/1989 | Moynihan | |
| 5,113,727 | A | | 5/1992 | Foster | |
| 6,336,387 | B1 | | 1/2002 | Lee | |
| 6,647,835 | B1 | | 11/2003 | Tseng | |
| 7,086,312 | B1 | | 8/2006 | Tortolani | |
| 7,299,724 | B1 | * | 11/2007 | Warheit | 81/413 |
| 2011/0296963 | A1 | | 12/2011 | Steele et al. | |

OTHER PUBLICATIONS

Charles M. Phillips Sr., et al., International Search Report, PCT/US13/59206, Feb. 10, 2014, 3 pages.

* cited by examiner

*Primary Examiner* — Hadi Shakeri

(74) *Attorney, Agent, or Firm* — Eckert Seamans Cherin & Mellott, LLC; David C. Jenkins

(57) ABSTRACT

A pair of pliers having replaceable jaws is provided. The first plier member has a handle and a jaw assembly. The first plier member jaw assembly includes a body defining an elongated slot and having at least one guide surface. The second plier member has a handle assembly and a jaw assembly. The second plier member jaw assembly is selectively disposed in one of two configurations, a first configuration, wherein the second plier member jaw assembly is separated from the first plier member, and a second configuration, wherein the second plier member jaw assembly is slidably coupled to the first plier member with the second plier member jaw assembly guide member at least one guide surface slidably engaging the first plier member jaw assembly body at least one guide surface.

18 Claims, 11 Drawing Sheets

REPLACEABLE JAW MEMBERS FOR PLIERS

FIELD OF THE INVENTION

The disclosed and claimed concept relates to pliers and, more specifically to pliers having replaceable jaws.

BACKGROUND INFORMATION

Traditional pliers have, generally, two elongated members each having a handle at one end and a jaw at the other. The members cross over each other and are coupled by a pivot pin, or similar device, at a single, medial pivot in a manner similar to scissors. One enhancement to traditional pliers includes a dual pivot point on one member. That is, one member includes two pivot openings joined by a passage. The pivot pin is fixed to the other member. A user may then position the pivot pin in one of the two pivot openings. Further, the user may switch the location of the pivot point by moving the pin through the passage into the other pivot opening. In this configuration, the spacing of the jaws and the closing characteristics of the pliers may be changed.

A further enhancement includes elongating the dual pivot point to be a channel. The channel allows the two plier members to be placed in a number of configurations wherein the initial configuration of the jaws has the jaws spaced, adjacent to each other, or somewhere in between. The plier members are maintained in a specific relationship by a locking mechanism associated with a pivot member. One common locking mechanism is a tongue-and-groove arrangement wherein the plier member having the slot includes a series of arcuate channels disposed on either side of the groove, and, the other plier member includes a cam, i.e. a tongue, that may be selectively placed in a groove. Engagement of the cam in a groove creates a pivot point. Thus, the cam is the pivot member. Another locking mechanism is a rack-and-pawl arrangement. A rack-and-pawl arrangement includes a rack disposed in, or adjacent to, the groove. The plier member that does not include the rack has a pawl disposed thereon. When the pawl engages the rack, a pivot point is created. Thus, the pawl is the pivot member. Accordingly, with channel pliers, the closing of the jaws may include two motions; a sliding motion as a pivot member, e.g. the cam or the pawl, moves longitudinally relative to the groove, and, a pivoting motion after the pivot member is engaged.

Locking pliers have at least four primary members: a first member, that is a combined jaw/handle, a second jaw assembly, a second handle assembly, and one or more linking members. The second jaw assembly is pivotally coupled to the first member adjacent to the first member jaw so that the jaw members may close together. The second handle assembly is pivotally coupled to the second jaw assembly at a location spaced from the jaw member pivot point. The linking member extends between the first handle member and the second handle assembly. More specifically, the linking member extends from the distal end of the first handle member to a location adjacent to the pivot coupling of the second jaw and second handle assembly.

Thus, the first member jaw assembly and the second jaw may be moved between a first, open position and a second, closed position. The second handle and the linking member also move between respective first positions and second positions corresponding to the position of the jaws. When the components of the locking pliers are in their respective first positions, the pliers are in a first, open configuration. Similarly, when the components of the locking pliers are in their respective second positions, the pliers are in a second, closed configuration. The locking pliers typically have one or more springs structured to bias the locking pliers to the first configuration.

Locking pliers may have improved operational capabilities by reconfiguring the elements or adding additional links to provide for an enhanced closing motion. For example, in one improvement the second handle assembly may be coupled to the first member adjacent to the jaw, and, a second linking member extends from the second handle assembly to the second jaw. With this addition, the line of force acting on the second linking member/second jaw coupling is generally more tangent to the first member/second jaw pivot and, as such, enhances the force applied by the user when compared to the configuration identified above.

All such pliers, however, have a fixed jaw shape. That is, the jaw members of the pliers may have different shapes, e.g. a common arcuate shape, an elongated "needle nose" shape, or any other shape. Because the jaws are unitary, or otherwise fixed to, the plier handles, the shape of the jaws cannot be changed.

As shown in U.S. Pat. No. 4,813,310, attempts have been made to provide pliers with replaceable jaws. As shown in the '310 patent, a replaceable jaw member was attached to a lug disposed at the upper end of a plier member. The replaceable jaw member was structured to slide axially over the lug. In this configuration, i.e. when the mount and the replaceable jaw member had these shapes, there were no surfaces on the lug, or adjacent surfaces, that resisted the upward axial movement of the replaceable jaw member. That is, the replaceable jaw member was only maintained in its position by a latching member. Unfortunately, such latching members could not maintain the replaceable jaw member in a substantially fixed position. Thus, the replaceable jaw member would wobble on the lug. This is not a desirable configuration for pliers.

SUMMARY OF THE INVENTION

The disclosed and claimed concept provides for a pair of pliers having replaceable jaws. That is, a pair of pliers includes a first plier member and a second plier member (or assembly) The first plier member has a handle and a jaw assembly, the first plier member jaw assembly includes an elongated body defining an elongated slot and having at least one guide surface. The first plier member jaw assembly at least one guide surface extends generally parallel to the longitudinal axis of the first plier member jaw assembly body slot. The second plier member has a handle assembly and a jaw assembly. The second plier member handle assembly includes a handle member having a first end. The second plier member handle assembly handle member is pivotally coupled to the first plier member handle. The second plier member handle assembly handle member first end disposed adjacent the first plier member jaw assembly slot. The second plier member handle assembly handle member first end includes a laterally offset extension that extends into the first plier member jaw assembly slot. The second plier member jaw assembly includes a body having a jaw member, a socket, and at least one laterally offset guide member having a guide surface. With these elements the second plier member jaw assembly is selectively disposed in one of at least two configurations, a first configuration, wherein the second plier member jaw assembly is separated from the first plier member, and a second configuration, wherein the second plier member jaw assembly is slidably coupled to the first plier member with the second plier member jaw assembly body socket coupled to the second plier member handle assembly handle member first end and the second plier member jaw assembly guide member at least one guide surface slidably engaging the first plier member jaw assembly body at least one guide surface.

It is noted that the second plier member jaw assembly body jaw member at least one laterally offset guide member having a guide surface extends generally perpendicular to the second plier member jaw assembly body jaw member longitudinal axis. In an exemplary embodiment, the second plier member jaw assembly body jaw member at least one laterally offset guide member having a guide surface faces upwardly. Conversely, the guide surface on the plier member faces downwardly. In this configuration, the second plier member jaw assembly body cannot move away from the surface to which it is slidably coupled, i.e. the plier member guide surface. That is, the second plier member jaw assembly body jaw member includes downwardly facing surfaces and the second plier member jaw assembly body jaw member at least one laterally offset guide member includes the upwardly facing guide surface. Both of these surfaces engage the plier member thereby resisting movement either upwardly or downwardly relative to the plier member. The first plier member jaw assembly body also includes a downwardly facing surface of the body and an upwardly facing surface. Thus, the shape of the second plier member jaw assembly body solves the problem of loose jaw members.

BRIEF DESCRIPTION OF THE DRAWINGS

A full understanding of the invention can be gained from the following description of the preferred embodiments when read in conjunction with the accompanying drawings in which:

FIG. 8A shows the second removable jaw member spaced from the first plier member. FIG. 8B shows the second removable jaw member partially installed on the first plier member. FIG. 8C shows the second removable jaw member installed on the first plier member.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body. With regard to elements constructed of laminations, it is understood that the word "unitary" means that the identified lamination is created as a single piece or unit and other laminations may be coupled thereto.

As used herein, directional indications, e.g. "upper," "lower," etc. are relative to the orientation of the pliers with the "upper" end being the end with the jaws. Directional indications are not limiting in the claims.

As used herein, "replaceable" or "temporarily coupled" means that an element may be selectively disposed in a specified configuration or selectively coupled to a specified element.

Figure 1:
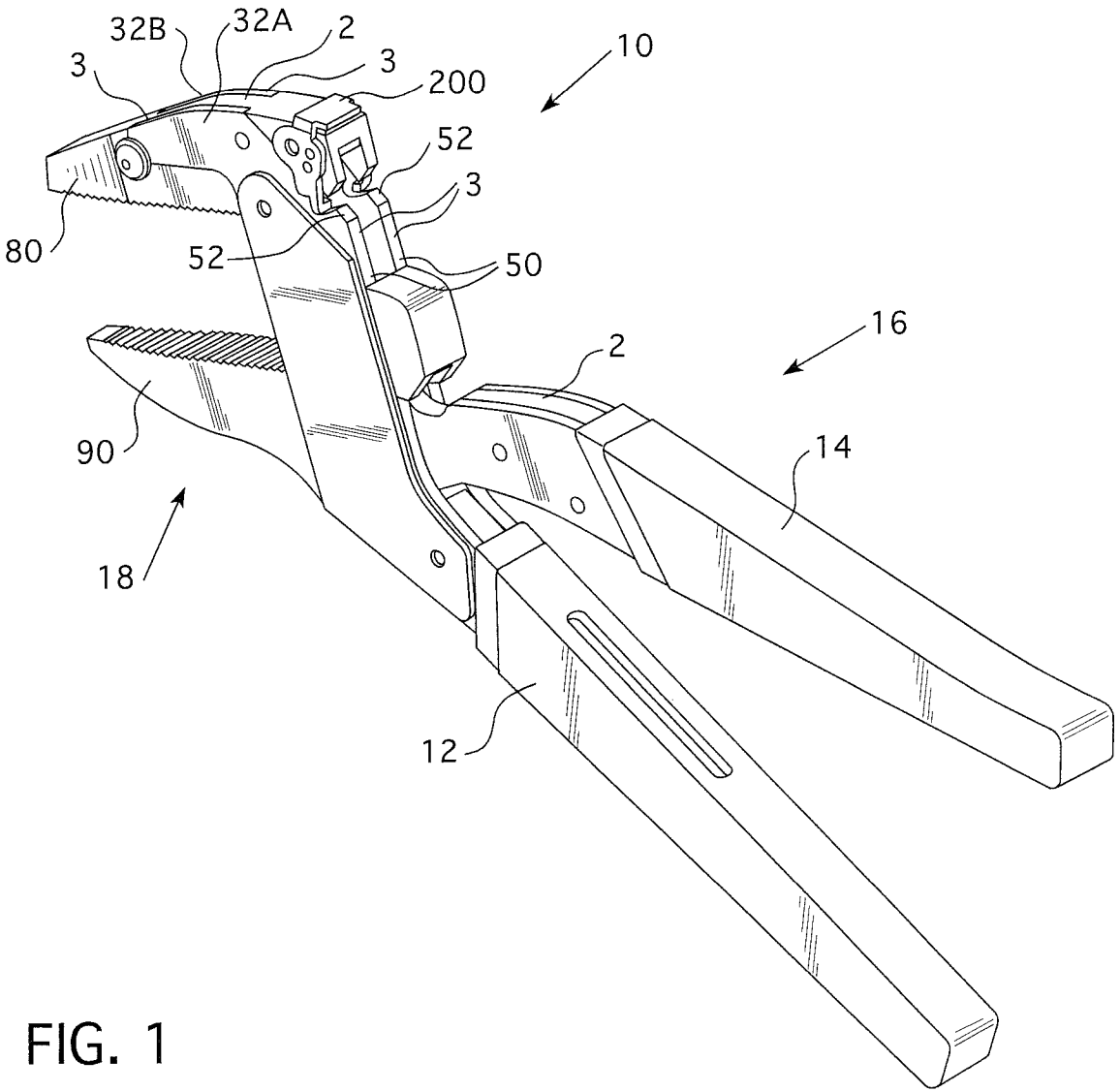
FIG. 1 is an isometric view of a pair of pliers.
Figure 2:
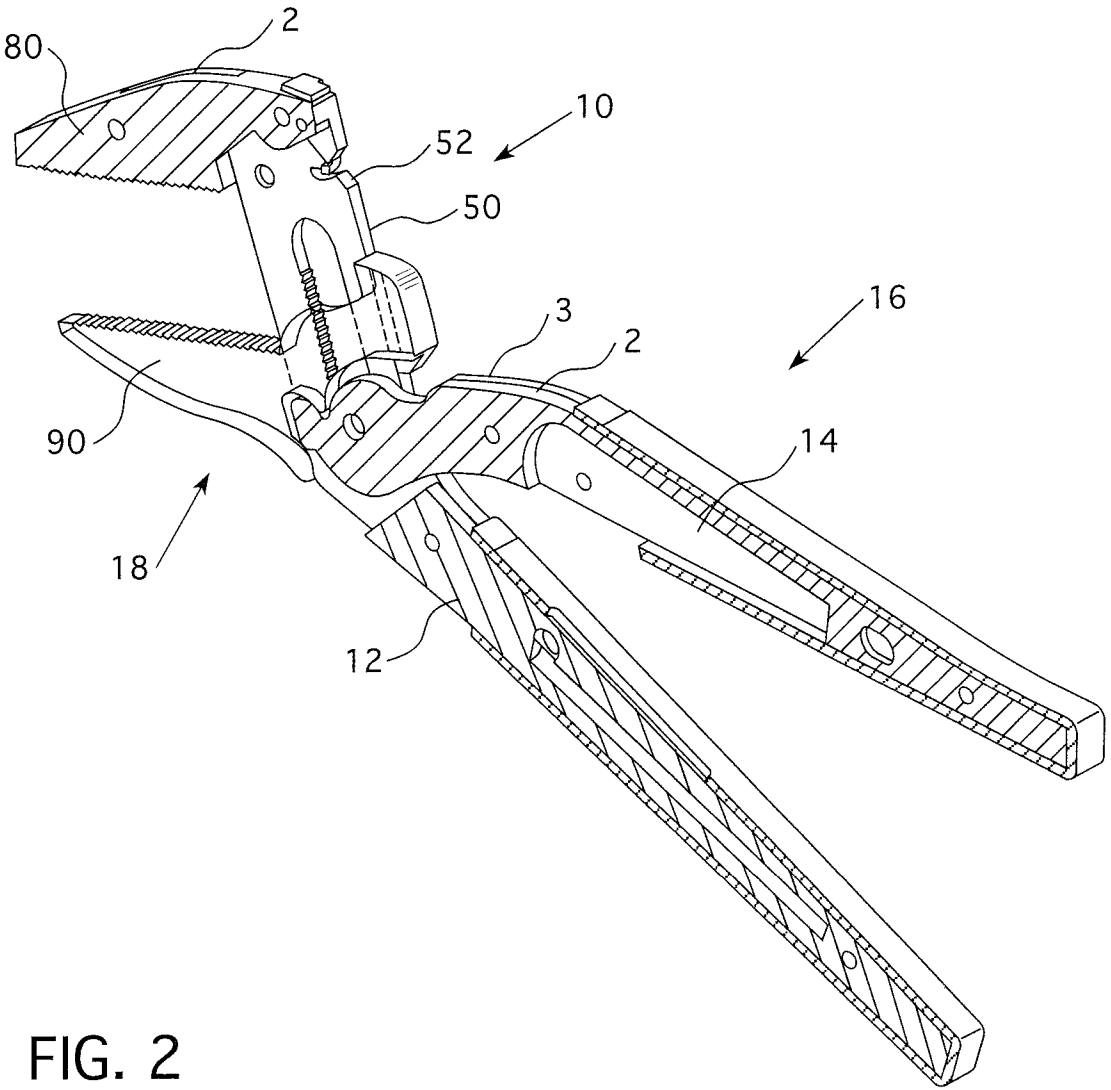
FIG. 2 is a cross-sectional isometric view of a pair of pliers.
Figure 3:
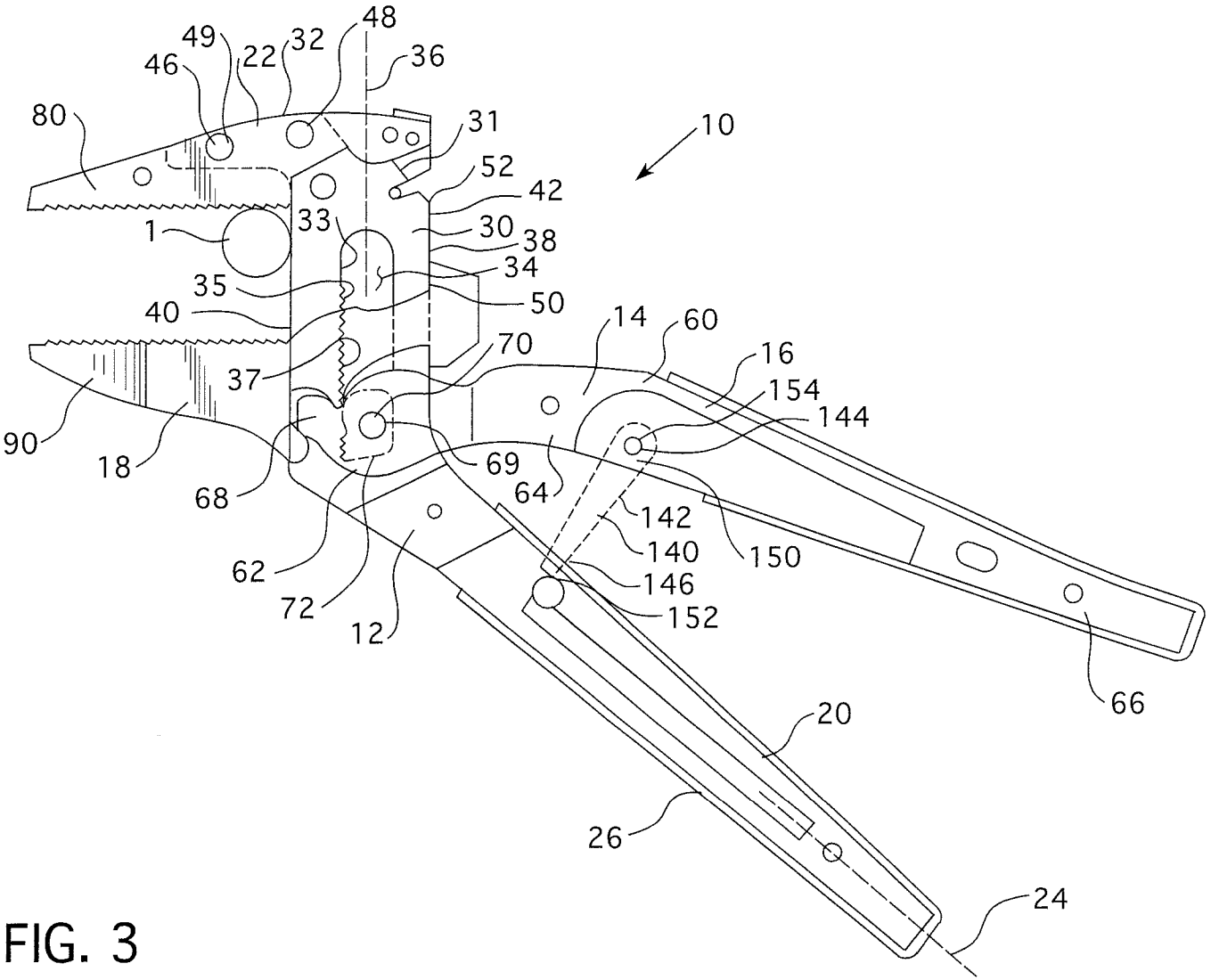
FIG. 3 is a cross-sectional side view of a pair of pliers.

As shown in FIGS. 1 and 2, a pair of pliers 10, hereinafter "pliers," are, in one embodiment, constructed from a plurality of laminations 2. Laminations 2, and partial laminations 3 (described below), may have different thicknesses. Pliers 10 include a first plier member 12 and a second plier member 14. Second plier member 14 includes a handle assembly 16 and a jaw assembly 18. By using a plurality of laminations 2, the pliers 10 may be constructed in various configurations while using the disclosed principle of operation. That is, one of the plier members (or member assembly) 12, 14 includes two substantially similar laminations 2 maintained in a spaced relationship while the other plier member 12, 14 includes a single lamination 2 that is disposed between the other member's 12, 14 spaced laminations 2. Pivot points and other devices that required the laminations 2 to interact are created by having an element, e.g. a pin for a pivot point, that extends laterally from a lamination 2. As the disclosed concept is not limited to a specific construction, the pliers 10 will be described as if generally comprised of two laminations. That is, the disclosed concept relates to the interaction of the plier members 12, 14 and not to their specific construction, so the plier members 12, 14 will be described as single layer laminations with associated interactions. As such, the description below shall refer to FIG. 3, which is a side cross-sectional view. It is noted that FIG. 3 is a cross-section of the middle lamination. For ease of understanding certain laterally offset elements, i.e. elements closer to the viewer, have been added and are shown in ghost. It is understood that to construct the claimed pliers, either plier member 12, 14 would include at least two, spaced laminations 2 while the other plier member 12, 14 would generally include a single lamination 2 disposed therebetween.

It is further understood that, as used herein, "laterally offset," "laterally extending," and similar phrases indicate that an element extends out of the plane of the lamination 2. For example, as shown in FIGS. 1 and 2, in a plier 10 having at least three laminations 2, 3, a first plier member jaw assembly 22 (discussed below) includes at least two spaced laminations 3. A first plier member jaw assembly first removable jaw member 80 (discussed below) includes at least a single lamination 2. The first plier member jaw assembly first removable jaw member 80 is disposed between the two laminations of the first plier member jaw assembly 22. It is understood that the laminations move in their own planes. When it is desirable to have elements interact, e.g. when the opposing jaw members 80, 90 (discussed below) close together, the elements include a laterally offset partial lamination. In this configuration, the offset partial laminations may interact with each other. Accordingly, an element described as a "laterally offset" element, "laterally extending" element, etc. is understood to extend into the plane of an adjacent lamination and may interact with elements in that other plane, i.e. with elements on a different plier member 12, 14. Further, unless otherwise stated, it is understood that where any interaction between elements on different planes, i.e. different laminations, is mentioned, there is a laterally offset element disposed on at least one of the plier members 12, 14 even if such an element is not specifically identified. For example, if a pivot point is identified, it is understood that at least one plier member 12, 14 includes a laterally extending pivot pin, or similar construct, at that location. It is noted that pliers 10 may include, and typically do include, more than three layers of laminations 2, 3.

It is noted that, for exemplary purposes, pliers 10 may be described as an embodiment wherein first plier member 12 has two, spaced laminations 2 and second plier member 14 has, generally, a single lamination 2 that is disposed between the laminations 2 of the first plier member 12. Such a description is for exemplary purposes only and, as noted above, pliers 10 may be constructed with alternative lamination configurations, e.g. first plier member 12 may be, generally, one lamination 2 and second plier member 14 may be two spaced laminations 2.

As shown in FIG. 3, a pair of pliers include a first plier member 12 and a second plier member assembly 14. The second plier member 14 may be considered as a unit and, as such, may be identified herein as "second plier member 14." First plier member 12 includes an elongated handle 20 and a jaw assembly 22. First plier member elongated handle 20 has a longitudinal axis 24. First plier member elongated handle 20 may include a grip 26 disposed about all laminations 2 within the first plier member elongated handle 20. First plier member jaw assembly 22 includes an elongated body 30, a jaw mount 32, and a first removable jaw member 80 (described below). First plier member jaw assembly elongated body 30 defines an elongated slot 34 with a longitudinal axis 36. First plier member jaw assembly elongated body slot 34 has an upper surface 33 with a rack 35. That is, rack 35 is a plurality of teeth 37 structured to be engaged by a pawl. First plier member jaw assembly elongated body 30 further includes at least one guide surface 38. In the disclosed embodiment, first plier member jaw assembly elongated body 30 is generally rectangular and includes an upper guide surface 40 and a lower guide surface 42. That is, the outer longitudinal surfaces of first plier member jaw assembly elongated body 30 are the upper guide surface 40 and the lower guide surface 42. Thus, first plier member jaw assembly elongated body upper guide surface 40 and first plier member jaw assembly elongated body lower guide surface 42 are substantially parallel and extend generally parallel to the first plier member jaw assembly body slot longitudinal axis 36.

First plier member jaw assembly elongated body lower guide surface 42 interacts with the second plier member jaw assembly body laterally offset guide member at least one guide surface 97, described below. That is, the second plier member jaw assembly body laterally offset guide member at least one guide surface 97, and more specifically the second plier member jaw assembly body laterally offset lower guide surface 99, moves over the first plier member jaw assembly elongated body lower guide surface 42. Accordingly, first plier member jaw assembly elongated body lower guide surface 42 includes a use surface 50 and a release end 52. As described below, use surface 50 is the portion of the first plier member jaw assembly elongated body lower guide surface 42 over which the second plier member jaw assembly body laterally offset lower guide surface 99 moves while in use. Further, when second plier member jaw assembly body laterally at least one offset guide member guide surface 98, and more specifically the second plier member jaw assembly body laterally offset lower guide surface 99 (described below), is disposed at first plier member jaw assembly body lower guide surface release end 52, second plier member jaw assembly 18 may be separated from the second plier member handle 16 as well as first plier member 12.

First plier member jaw assembly mount 32 extends generally perpendicular to first plier member jaw assembly slot longitudinal axis 36. First plier member jaw assembly mount 32 includes a coupling device 46, discussed below and which is shown in FIG. 3 as openings 48 for fasteners 49. It is noted that first plier member handle longitudinal axis 24 is disposed at an angle relative to first plier member jaw assembly slot longitudinal axis 36. In an exemplary embodiment, the angle between first plier member handle longitudinal axis 24 and first plier member jaw assembly slot longitudinal axis 36 is at least 100 degrees.

Figure 4:
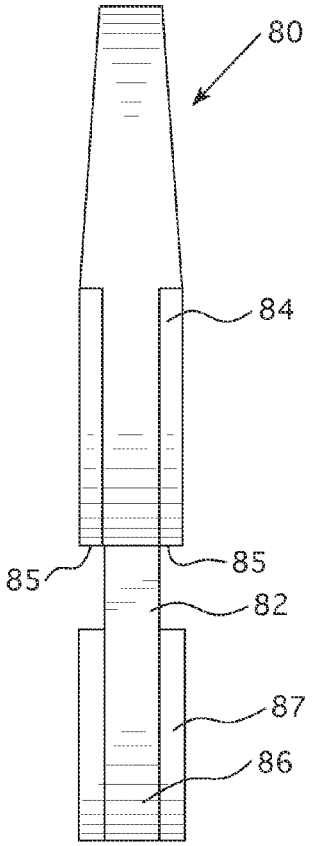
FIG. 4 is a detail end view of a first removable jaw member.
Figure 5:
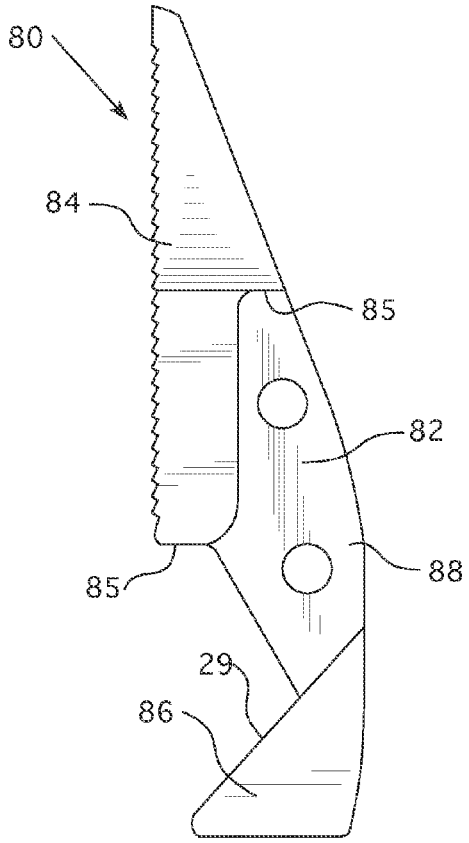
FIG. 5 is a detail side view of a first removable jaw member.

As shown in FIGS. 4 and 5, first plier member jaw assembly first removable jaw member 80 includes a body 82 having an upper jaw portion 84, a lower mount portion 86, and a medial portion 88. First plier member jaw assembly first removable jaw member 80 is selectively disposed in one of two configurations, a first configuration, wherein the first plier member jaw assembly first removable jaw member 80 is separated from the first plier member 12, and a second configuration, wherein the first plier member jaw assembly first removable jaw member 80 is coupled to the first plier member 12 and, more specifically to first plier member jaw assembly mount 32. First plier member jaw assembly first removable jaw member body upper jaw portion 84 may be any shape and is shown as an elongated jaw with a generally planar gripping surface having teeth. It is understood that any jaw shape may be utilized. First removable jaw member body upper jaw portion 84 may include a plurality of partial laminations (not shown) structured to increase the thickness of first removable jaw member body upper jaw portion 84. Alternatively, the first removable jaw member body upper jaw portion 84 may have a greater thickness. The first removable jaw member body upper jaw portion 84 includes downwardly facing surfaces 85, i.e. the lower surfaces of the laminations 3 or the portion with the greater thickness. The first removable jaw member body upper jaw portion downwardly facing surfaces 85 are structured to engage the first plier member jaw assembly mount 32.

As shown in FIG. 4, first plier member jaw assembly first removable jaw member body lower mount portion 86 includes at least one laterally offset body 87 shaped to correspond with the shape of first plier member jaw assembly mount 32. As shown, first plier member jaw assembly mount 32 has an angled surface 29. First plier member jaw assembly first removable jaw member body lower mount portion offset body 87 also includes an angled surface sized and shaped to correspond with the shape of first plier member jaw assembly mount angled surface 31. That is, in an exemplary embodiment, first plier member jaw assembly mount 32 is two similarly shaped laminations disposed in spaced relationship. First plier member jaw assembly first removable jaw member body 82 includes a central lamination 2 and at least one laterally offset partial lamination 3 at first plier member jaw assembly first removable jaw member body lower mount portion 86. More specifically, in this exemplary configuration, first plier member jaw assembly first removable jaw member body lower mount portion 86 includes two offset partial lamination 3, one on each side of the central lamination 2 of first plier member jaw assembly first removable jaw member body 82. These partial laminations 3 are the first plier member jaw assembly first removable jaw member body lower mount portion offset body 87. The central lamination 2 of first plier member jaw assembly first removable jaw member body 82, and more specifically, first plier member jaw assembly first removable jaw member body medial portion 88, is disposed between the spaced laminations 2 of the first plier member jaw assembly mount 32. In this configuration, the two offset partial laminations 3, i.e. the first plier member jaw assembly first removable jaw member body lower mount portion offset bodies 87, will be in the same plane as one of the laminations 2 of the first plier member jaw assembly mount 32. Thus, the first plier member jaw assembly mount angled surfaces 31, that is one first plier member jaw assembly mount angled surface 31 on each lamination 2, are engaged by one of the first plier member jaw assembly first removable jaw member body lower mount portion offset bodies 87. It is noted that the one first plier member jaw assembly mount angled surface 31 is an upwardly facing surface 83. The first plier member jaw assembly mount angled surface 31, which faces upwardly, is structured to engage the first plier member jaw assembly mount 32.

Figure 10:
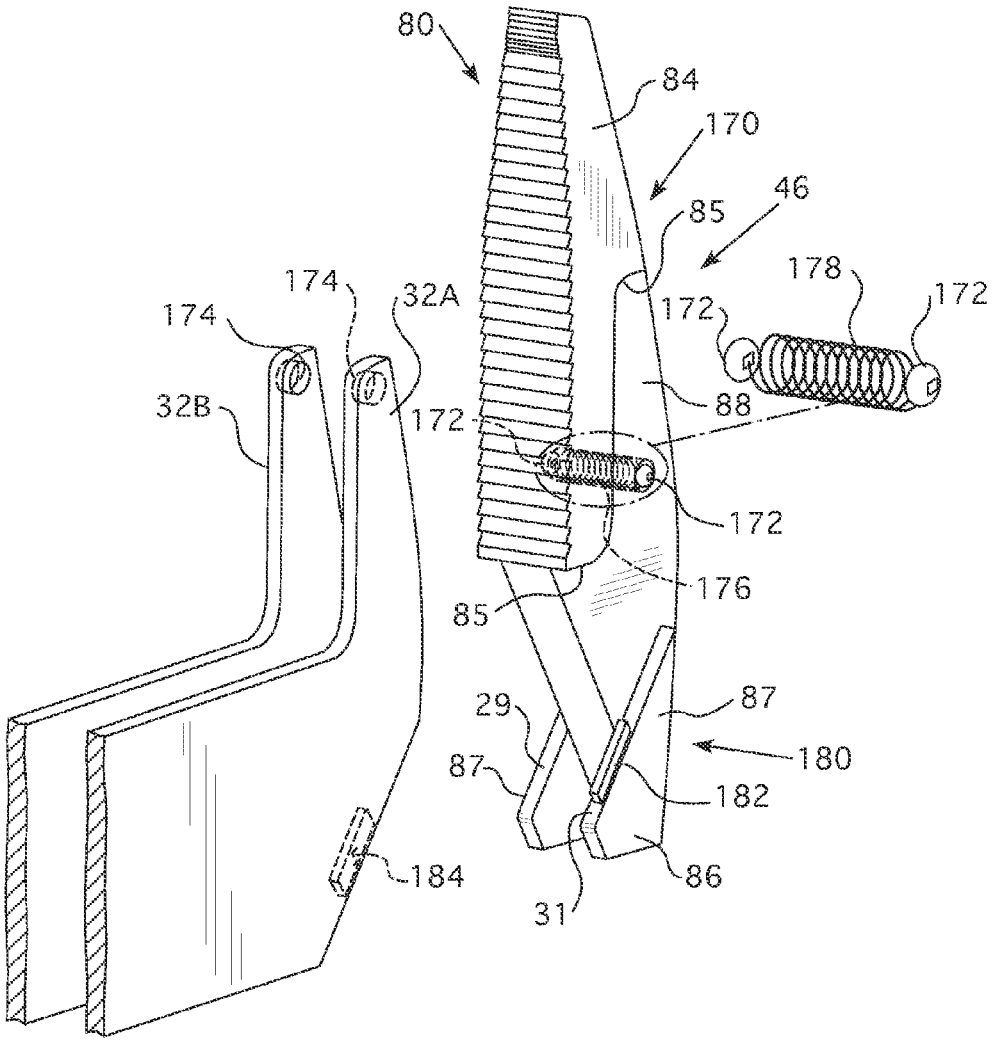
FIG. 10 is an isometric view of a locking assembly.
Figure 11:
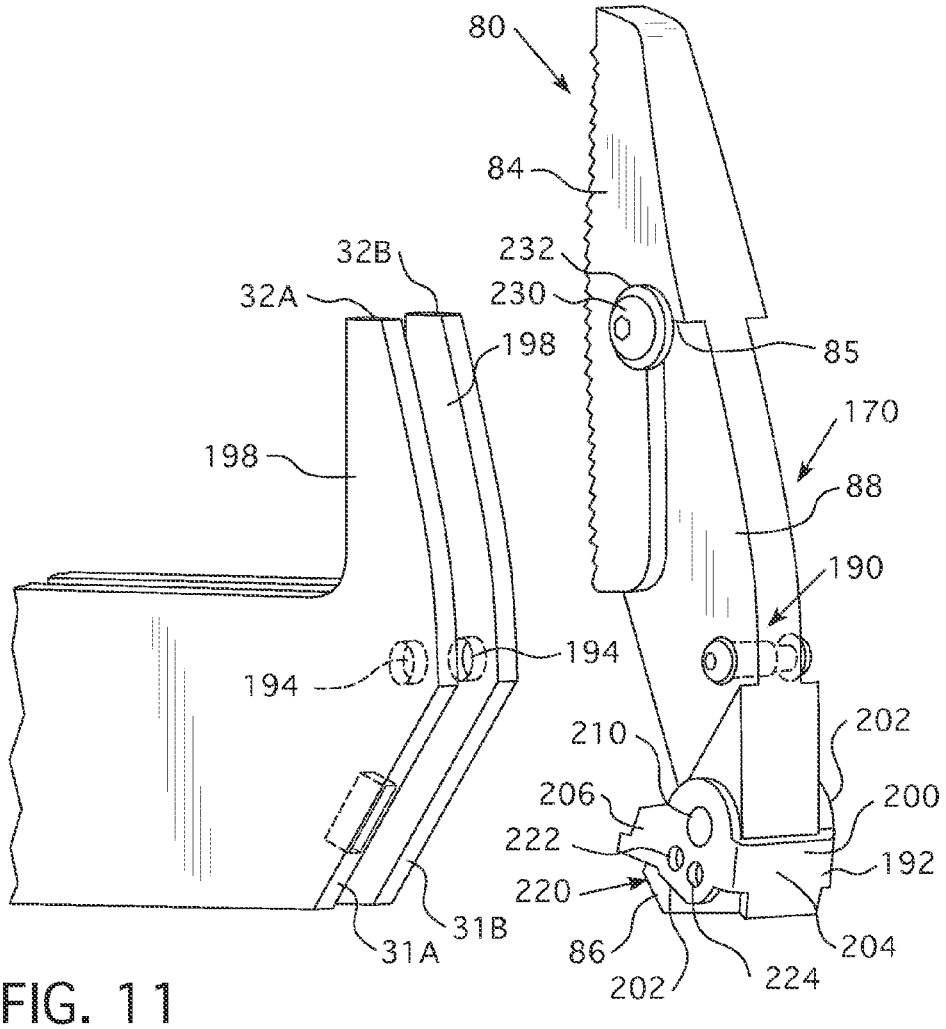
FIG. 11 is an isometric view of an alternate locking assembly.

Further, coupling device 46 may be a releasable locking assembly 170, as shown in FIGS. 10 and 11. As used herein, a "releasable locking assembly" is an assembly structured to selectively couple separate components in a fixed relationship and which can be released without the use of tools. Thus, releasable locking assembly 170 is structured to selectively couple the first plier member jaw assembly first removable jaw member 80 and the first plier member jaw assembly mount 32. As shown in FIG. 10, one embodiment, a releasable locking assembly 170, includes a ball 172 structured to engage a detent 174. That is, as shown, the first plier member jaw assembly first removable jaw member body medial portion 88 includes a laterally extending ball 172 and the first plier member jaw assembly mount 32 includes a corresponding detent 174. When the first plier member jaw assembly first removable jaw member body 82 is in the second configuration, the first plier member jaw assembly first removable jaw member body ball 172 is disposed in the first plier member jaw assembly mount detent 174.

In one embodiment, the releasable locking assembly 170 includes two opposed spring-biased balls 172 structured to engage opposing detents 174. For the sake of an example, an embodiment is disclosed wherein the first plier member jaw assembly mount 32 includes two spaced first plier member jaw assembly mounts 32A, 32B (FIGS. 1 and 10). The releasable locking assembly opposing detents 174 are disposed on the inner surfaces of the two first plier member jaw assembly mount jaw assembly mounts 32A, 32B. Further, the first plier member jaw assembly first removable jaw member body lower mount portion 86, with the exception of the laterally offset body 87, is sized to fit snuggly between the two first plier member jaw assembly mount jaw assembly mounts 32A, 32B. The first plier member jaw assembly first removable jaw member body lower mount portion 86 includes a bore 176. When the first plier member jaw assembly first removable jaw member 80 is in the second configuration, the bore 176 is aligned with the releasable locking assembly opposing detents 174. The releasable locking assembly spring-biased balls 172, including a medial spring 178, are disposed in the bore 176. In this configuration, and when the first plier member jaw assembly first removable jaw member 80 is in the second configuration, the releasable locking assembly spring-biased balls 172 are biased into the releasable locking assembly opposing detents 174 thereby releasably locking the first plier member jaw assembly first removable jaw member 80 in the second configuration. A user may selectively release the releasable locking assembly 170 without tools by applying sufficient force to overcome the bias of the releasable locking assembly spring 178 causing the releasable locking assembly spring-biased balls 172 to move out of the releasable locking assembly opposing detents 174.

The releasable locking assembly 170 may further include un-biased ball-and-detent couplings, not shown. In this embodiment the two spaced first plier member jaw assembly mounts 32A, 32B may flex slightly thereby allowing the opposed balls to be fixed to the outer surface of the first plier member jaw assembly first removable jaw member body medial portion 88. Further, other embodiments of the releasable locking assembly 170 include, but are not limited to, a leaf spring structured to engage a channel with a corresponding shape, interlocking surfaces, or a lever operated clamp assembly (none shown).

The releasable locking assembly 170 may further include an alignment device 180. The alignment device 180 is structured to help maintain the first plier member jaw assembly first removable jaw member 80 in a selected location relative to the first plier member jaw assembly mount 32. In the disclosed embodiment, the alignment device 180 includes a tongue-and-groove construct. That is, in the embodiment shown, the angled surfaces of the first plier member jaw assembly first removable jaw member body lower mount portion 86 include a tongue 182, i.e. a ridge, and the first plier member jaw assembly mount angled surface 31 includes a groove 184. The tongue 182 and the groove 184 have a corresponding shape. When the first plier member jaw assembly first removable jaw member 80 is in the second configuration and when the tongue 182 is disposed in the groove 184, the first plier member jaw assembly first removable jaw member 80 is less able to move relative to the first plier member jaw assembly mount 32. Thus, the alignment of the first plier member jaw assembly first removable jaw member 80 relative to the first plier member jaw assembly mount jaw assembly mount 32 is maintained.

In another embodiment, shown in FIG. 11, releasable locking assembly 170 includes a pair of opposed balls 190, a pivoting clip assembly 192, and opposed detents 194. Further in this embodiment, the two first plier member jaw assembly mounts 32A, 32B are structured to be spaced apart at the location of the opposed detents 194. That is, first plier member jaw assembly first removable jaw member 80 includes a pair of opposed balls 190 which, as shown, are disposed on the first plier member jaw assembly first removable jaw member body medial portion 88. The pair of opposed balls 190 extend laterally. The opposed detents 194 are disposed in the inner surface of the two first plier member jaw assembly mounts 32A, 32B at a location wherein, when the first plier member jaw assembly first removable jaw member 80 is in the second configuration, the pair of opposed balls 190 will seat in the opposed detents 194.

As noted above, in this embodiment the two first plier member jaw assembly mounts 32A, 32B are structured to be spaced apart at the location of the opposed detents 194. The spacing allows the pair of opposed balls 190 to pass between the two first plier member jaw assembly mounts 32A, 32B during installation of the first plier member jaw assembly first removable jaw member 80. The spacing of the two first plier member jaw assembly mounts 32A, 32B may be accomplished by any known configuration, including, but not limited to having the two first plier member jaw assembly mounts 32A, 32B flare outwardly, or, constructing the two first plier member jaw assembly mounts 32A, 32B such that medial portions 198 of two first plier member jaw assembly mounts 32A, 32B bow outwardly. It is noted that the degree of flare or the amount of bowing may be just enough to allow the pair of opposed balls 190 to pass between the two first plier member jaw assembly mounts 32A, 32B.

In this embodiment, releasable locking assembly 170 utilizes pivoting clip assembly 192 to compress, i.e. that is draw together, the two first plier member jaw assembly mounts 32A, 32B. This action traps the opposed balls 190 in the opposed detents 194 thereby locking the first plier member jaw assembly first removable jaw member 80 in place. Pivoting clip assembly 192 includes a clip body 200 and a pivot pin 210. Pivoting clip assembly body 200 is rotatably coupled to first plier member jaw assembly first removable jaw member body lower mount portion 86. Pivoting clip assembly body 200, as shown, is a U-shaped body having two generally parallel arms 202 and a laterally extending base 204. Each pivoting clip arm 202 includes an opening (not shown) and a radial extension 206. Pivoting clip arms 202 are spaced to correspond to the thickness of first plier member jaw assembly first removable jaw member body lower mount portion 86. First plier member jaw assembly first removable jaw member body lower mount portion 86 includes an opening (not shown) for a pivot pin 210. Further, each pivoting clip arm 202 may include a laterally, inwardly extending tab 203, and, the first plier member assembly mount angled surface 31 may include a notch 212. When the pivoting clip assembly body 200 is in a second position, described below, pivoting clip arm tabs 203 are disposed in a corresponding first plier member assembly mount angled surface notch 212.

When installed, pivoting clip assembly 192 is disposed with pivoting clip arms 202 on each side of first plier member jaw assembly first removable jaw member body lower mount portion 86. The pivoting clip opening is aligned with the opening in the first plier member jaw assembly first removable jaw member body lower mount portion 86 and pivot pin 210 is passed therethrough. Pivoting clip arms 202 have a sufficient length to extend over first plier member jaw assembly mounts 32A, 32B in selected orientations. That is, pivoting clip assembly body 200 is structured to move between two positions; a first position, wherein pivoting clip arms 202 are not disposed over first plier member jaw assembly mounts 32A, 32B, and, a second position, wherein pivoting clip arms 202 are disposed over first plier member jaw assembly mounts 32A, 32B. Thus, when the pivoting clip assembly 192 is in the second position, the pivoting clip arms 202 compress first plier member jaw assembly mounts 32A, 32B. Compression by the pivoting clip arms 202 moves first plier member jaw assembly mounts 32A, 32B closer together thereby trapping the pair of opposed balls 190 in the opposed detents 194. It is noted that the lower edge of the first plier member jaw assembly mounts 32A, 32B may be tapered to more easily allow pivoting clip arms 202 to move over the first plier member jaw assembly mounts 32A, 32B. Further, rotation of pivoting clip assembly 192 may be accomplished by applying a rotational force to pivoting clip base 204.

Further, pivoting clip assembly 192 may include its own locking device 220 structured to maintain pivoting clip assembly 192 in one of the first and/or second position. For example, pivoting clip arms 202 may include a detent, two as shown 222, 224, on the inner surface. First plier member jaw assembly first removable jaw member body lower mount portion 86 may include a corresponding ball (not shown) that extends laterally. The pivoting clip arm detents 222, 224 are positioned so as to be disposed over the first plier member jaw assembly first removable jaw member body lower mount portion ball 224, when the pivoting clip assembly 192 is in one of the first or second positions.

Further, the first plier member jaw assembly first removable jaw member 80 may include a trapping device 230 structured to trap the distal ends of first plier member jaw assembly mounts 32A, 32B. As shown, first plier member jaw assembly first removable jaw member trapping device 230 includes a disk 232 coupled to the lateral surface of first plier member jaw assembly first removable jaw member 80 adjacent the interface with the distal ends of first plier member jaw assembly mounts 32A, 32B. When first plier member jaw assembly first removable jaw member 80 is installed, a portion of disk 232 is structured to be disposed over a portion of the distal ends of first plier member jaw assembly mounts 32A, 32B. In an embodiment wherein the distal ends of first plier member jaw assembly mounts 32A, 32B are flared, the user may have to pinch the distal ends of first plier member jaw assembly mounts 32A, 32B together in order for the distal ends of first plier member jaw assembly mounts 32A, 32B to slide under disk 232.

Further, when the first plier member jaw assembly first removable jaw member 80 is in the second configuration, first plier member jaw assembly first removable jaw member body lower mount portion offset body 87 lower surface is disposed adjacent to, and generally aligned with, the first plier member jaw assembly elongated body lower guide surface 42. In this configuration, the first plier member jaw assembly first removable jaw member body lower mount portion offset body 87 lower surface effectively extends the length of the first plier member jaw assembly body lower guide surface 42. Thus, in this configuration, when the second plier member jaw assembly body laterally offset lower guide surface 99 is disposed at, or beyond, release end 52, then when second plier member jaw assembly body laterally at least one offset guide member guide surface 97, and more specifically the second plier member jaw assembly body laterally offset lower guide surface 99 (described below), will slidably engage first plier member jaw assembly first removable jaw member body lower mount portion offset body 87 lower surface.

First plier member jaw assembly first removable jaw member 80 may be selectively coupled to first plier member jaw assembly mount 32. First plier member jaw assembly first removable jaw member 80 may be secured to first plier member jaw assembly mount 32 by any known coupling device. As shown in FIG. 3, first plier member jaw assembly mount 32 includes openings 48 which may be threaded. Thus, fasteners 49 may be passed through one lamination of the first plier member jaw assembly mount 32 and the first plier member jaw assembly first removable jaw member 80 then engage the threaded opening 48.

As noted above, second plier member 14 includes a handle assembly 16 and a jaw assembly 18. Second plier member handle assembly 16 includes a handle member 60 having an upper, first end 62, a medial portion 64 and a lower, second end 66. Second plier member handle member 60 may include a grip 26 disposed about all laminations 2 within the second plier member handle member 60. The second plier member handle member 60 is slidably and pivotally coupled to the first plier member 12 as described below. Second plier member handle assembly first end 62 includes a plug 68 structured to be pivotally disposed in second plier member jaw assembly body socket 94, as described below. Second plier member handle member first end 62 further includes a laterally offset extension 69. In the disclosed embodiment, second plier member handle assembly first end laterally offset extension 69 includes a pin 70 and a pawl 72. Pawl 72 is rotatably disposed on pin 70. As pin 70, and therefore pawl 72, are laterally offset, pawl 72 is disposed in first plier member jaw assembly elongated body slot 34 when pliers 10 are assembled, as described below. Thus, second handle member first end 62 is disposed adjacent said first plier member jaw assembly elongated body slot 34.

Figure 6:
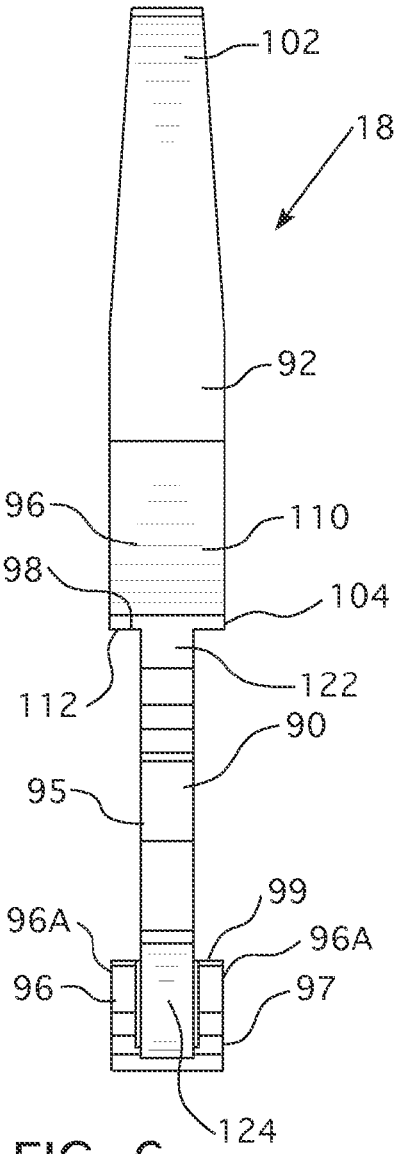
FIG. 6 is a detail end view of a second removable jaw member.
Figure 7:
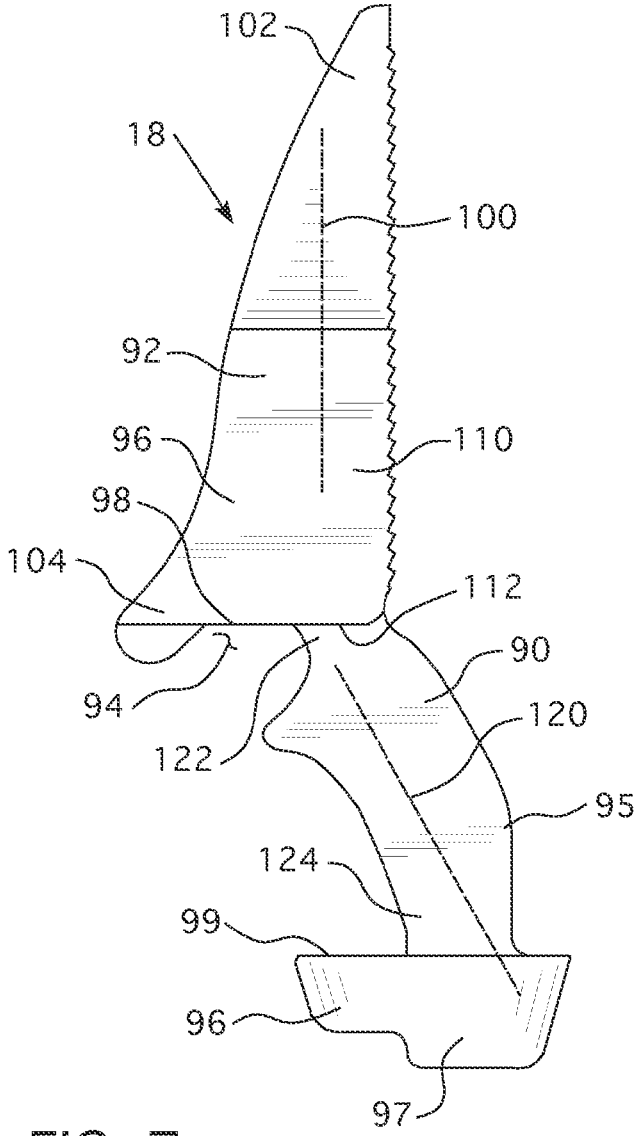
FIG. 7 is a detail side view of a second removable jaw member.

As shown in FIGS. 6 and 7, second plier member jaw assembly 18 is a removable jaw assembly. That is, second plier member jaw assembly 18 may be selectively disposed in one of at least two configurations, a first configuration, wherein said second plier member jaw assembly 18 is separated from the first plier member 12, and a second configuration, wherein the second plier member jaw assembly 18 is slidably coupled to the first plier member 12, as described below. Second plier member jaw assembly 18 includes a body 90 with a jaw member 92, a socket 94, a medial portion 95, and at least one laterally offset guide member 96 having a guide surface 97. The second plier member jaw assembly at least one guide member guide surface 97 is structured to be slidably coupled to first plier member jaw assembly elongated body at least one guide surface 38 when the second plier member jaw assembly 18 is coupled to the first plier member 12. Thus, when the second plier member jaw assembly 18 is coupled to the first plier member 12, second plier member jaw assembly at least one guide member guide surface 97, preferably, extends generally parallel to the first plier member jaw assembly elongated body lower guide surface 42 or first plier member jaw assembly elongated body upper guide surface 40.

It is noted that first plier member jaw assembly elongated body upper guide surface 40 is an upwardly facing guide surface and that first plier member jaw assembly elongated body lower guide surface 42 is downwardly facing guide surface. Conversely, the second plier member jaw assembly body laterally offset guide member at least one guide member guide surface 97 includes a downwardly facing upper guide surface 98 (herein "second plier member jaw assembly body laterally offset upper guide surface" 98) and an upwardly facing lower guide surface (herein "second plier member jaw assembly body laterally offset lower guide surface" 99). Thus, both the first plier member jaw assembly first removable jaw member 80 and the second plier member jaw assembly body jaw member 92 each have both upwardly and downwardly facing surfaces that are structured to be coupled to corresponding downwardly and upwardly facing surfaces on the plier members 12, 14.

Second plier member jaw assembly body jaw member 92 is structured to engage first plier member jaw assembly first removable jaw member 80. That is, second plier member jaw assembly body jaw member 92 typically mirrors the shape of first plier member jaw assembly first removable jaw member 80. Thus, as shown, second plier member jaw assembly body jaw member 92 is shown as an elongated jaw with a generally planar gripping surface having teeth. As with first plier member jaw assembly first removable jaw member 80, the second plier member jaw assembly body jaw member 92 may have any shape. As shown, second plier member jaw assembly body jaw member 92 has a longitudinal axis 100, an upper, first end 102 and a lower, second end 104.

Further, the second plier member jaw assembly body jaw member 92 includes partial laminations 3 that are laterally offset. In this exemplary embodiment, there are two partial laminations 3, one on each side of second plier member jaw assembly body jaw member 92. The laterally offset partial laminations 3 on the second plier member jaw assembly body jaw member 92 act as guide members 110. That is, in this exemplary embodiment and for the reasons explained above with regard to the first plier member jaw assembly first removable jaw member body lower mount portion offset body 87, and when the second plier member jaw assembly 18 is in the second configuration, the offset partial laminations 3 are disposed in the planes of the first plier member jaw assembly elongated body 30. More specifically, the second plier member jaw assembly body jaw member guide members 110 are upper guide members 110 and the lower surface thereof is an upper guide surface 112. As discussed below, the second plier member jaw assembly body jaw member guide member upper guide surface 112 is structured to slidably engage first plier member jaw assembly elongated body upper guide surface 40.

Second plier member jaw assembly body socket 94 is, preferably, disposed at second plier member jaw assembly body jaw member second end 104. The second plier member jaw assembly body socket 94 is, preferably, a rounded socket structured to allow a plug to pivot therein. The second plier member jaw assembly body socket 94 corresponds to the shape of the second plier member handle assembly first end plug 68.

Second plier member jaw assembly body medial portion 95 is elongated and includes a longitudinal axis 120, an upper, first end 122, a lower, second end 124. The second plier member jaw assembly body medial portion 95 is coupled to the second plier member jaw assembly body jaw member 92 with the second plier member jaw assembly body medial portion longitudinal axis 120 disposed at an angle to the second plier member jaw assembly body jaw member longitudinal axis 100. In this configuration, second plier member jaw assembly body medial portion second end 124 is offset (not laterally offset) in the angled direction from the second plier member jaw assembly body jaw member 92. It is this offset that allows second plier member jaw assembly body medial portion second end 124 to be positioned beyond the release end 52 of first plier member jaw assembly elongated body lower guide surface 42, as discussed below.

In one embodiment, a second plier member jaw assembly body at least one laterally offset guide member 96A is disposed at second plier member jaw assembly body medial portion second end 124. As before, the second plier member jaw assembly body at least one laterally offset guide member 96A is a partial lamination 3 and, more preferably, partial laminations disposed on each side of second plier member jaw assembly body medial portion second end 124. In this configuration, when the second plier member jaw assembly 18 is in the second configuration, the second plier member jaw assembly body laterally offset guide members 96A are disposed in the planes of the first plier member jaw assembly elongated body 30. More specifically, the second plier member jaw assembly body at least one laterally offset guide members 96A are lower guide members 97 and the upper surface thereof is a lower guide surface 99. As discussed below, the second plier member jaw assembly body at least one laterally offset guide member lower guide surface 99 is structured to slidably engage first plier member jaw assembly elongated body lower guide surface 42.

Thus, the second plier member jaw assembly body at least one laterally offset guide member 96A and the second plier member jaw assembly body jaw member guide member upper guide surface 112 are disposed on opposite sides of first plier member jaw assembly elongated body 30. The second plier member jaw assembly body at least one laterally offset guide member 96A and the second plier member jaw assembly body jaw member guide member upper guide surface 112 extend generally parallel to each other.

Second plier member handle assembly 16 may further includes a linkage assembly 140. Second plier member handle assembly linkage assembly 140 includes a link 142, a pivot 144, and a sliding coupling 146. Second plier member handle assembly linkage assembly link 142 has a first end 150 and a second end 152. Second plier member handle assembly linkage assembly link first end 150 includes pivot 154 and is pivotally coupled to second plier member handle assembly handle member medial portion 64. Second plier member handle assembly linkage assembly link second end 152 is slidably coupled to a medial portion of first plier member handle 20.

When assembled, pliers 10 have the following configuration. First plier member handle 20 and second plier member handle assembly handle member 60 are pivotally coupled by second plier member handle assembly linkage assembly 140 as described above. Further, as noted above, second handle member first end 62 is disposed adjacent the first plier member jaw assembly elongated body slot 34. Thus, second plier member handle member first end laterally offset extension 69 is disposed in the first plier member jaw assembly elongated body slot 34. In the exemplary embodiment, second plier member handle member first end laterally offset extension 69 includes a pawl 72 that is structured to engage the first plier member jaw assembly elongated body slot rack 35. That is, second plier member handle member first end laterally offset extension 69 does not engage first plier member jaw assembly elongated body slot rack 35 until the first plier member jaw assembly 22 and the second plier member jaw assembly 18 engage a work piece 1, as described below. Thus, second plier member handle member first end laterally offset extension 69 is slidably disposed in first plier member jaw assembly elongated body slot 34.

Figure 8A:
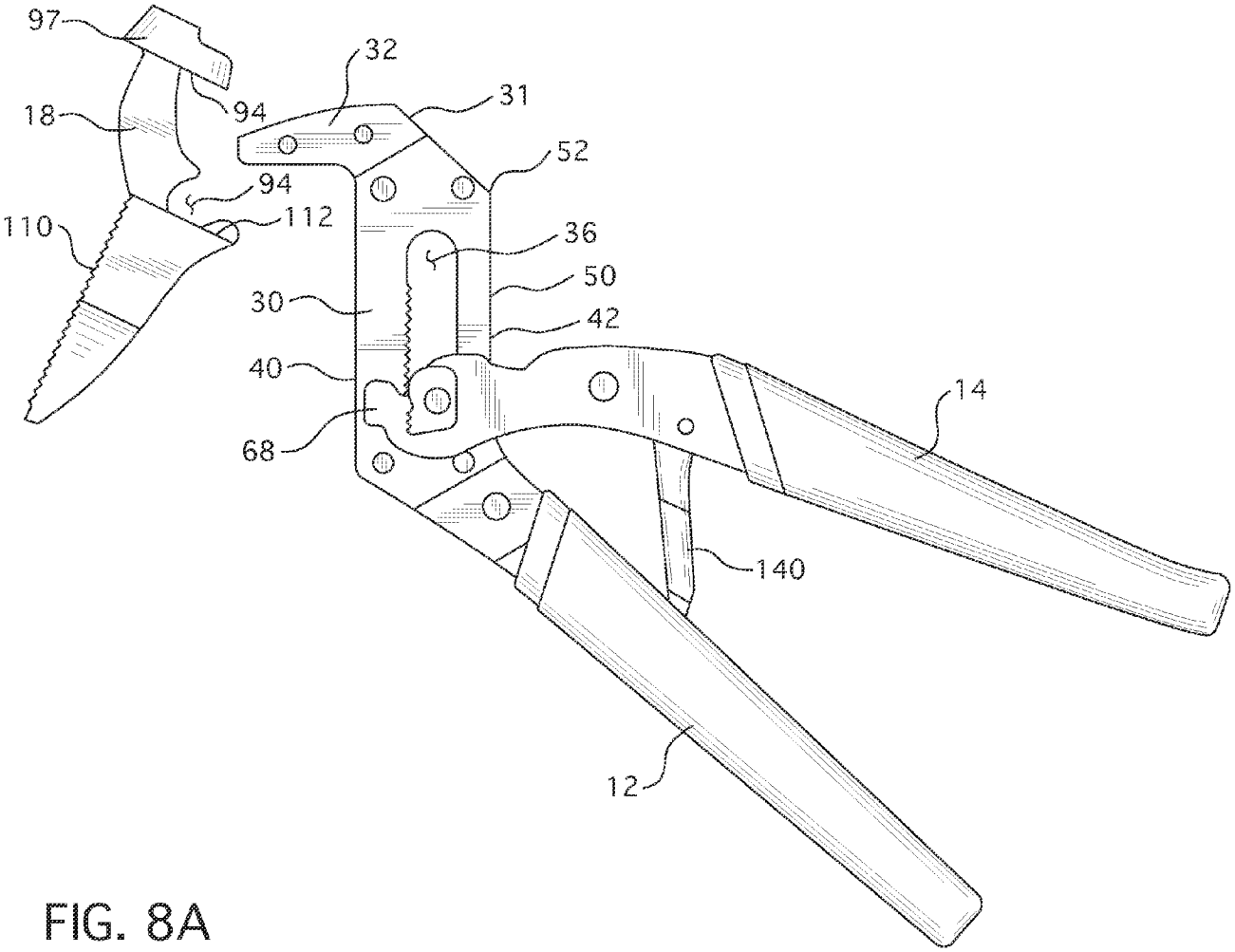
FIGS. 8A-8C are side views of pliers according to the present invention showing the installation of the second removable jaw member.
Figure 8B:
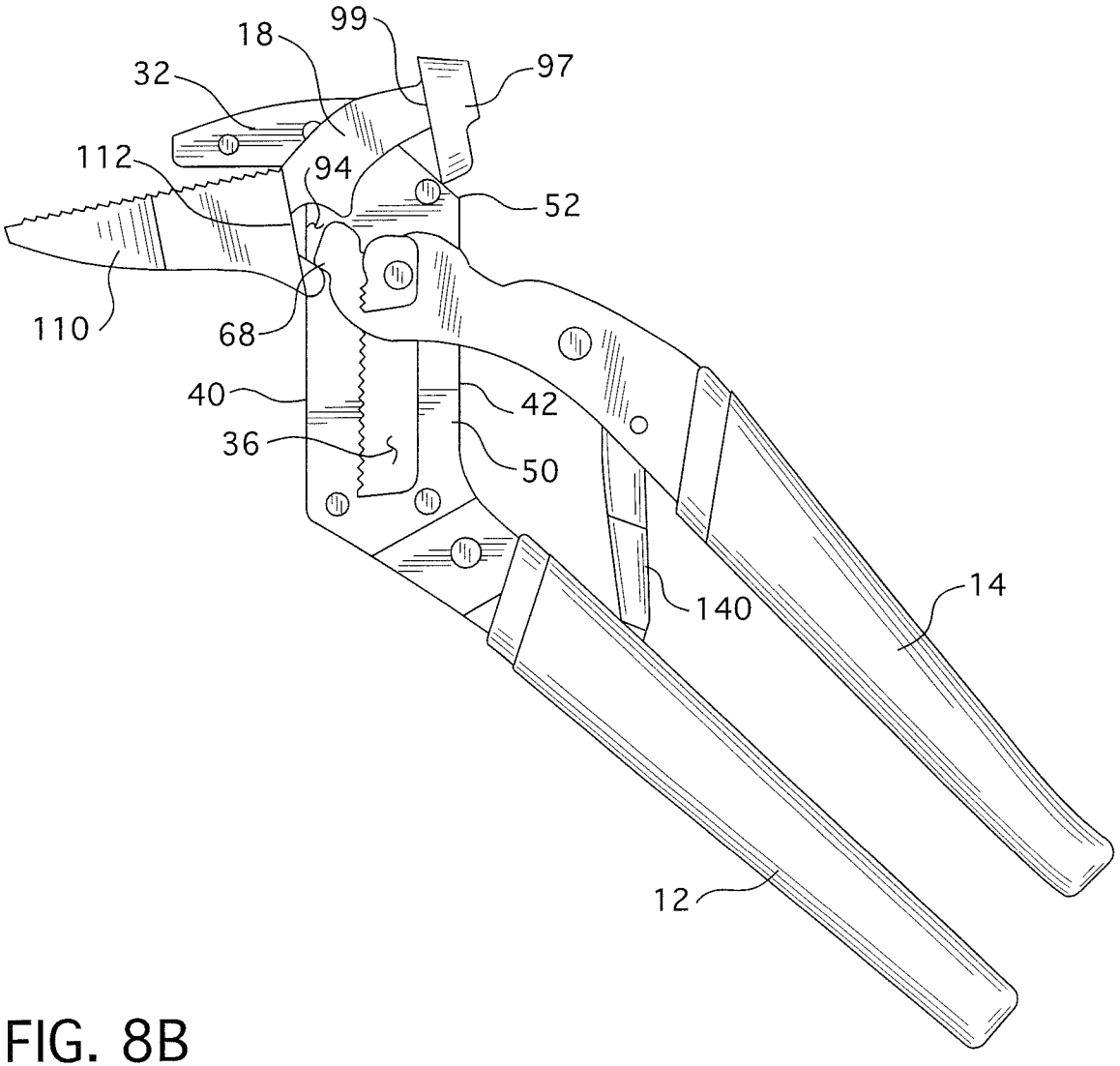
Figure 8C:
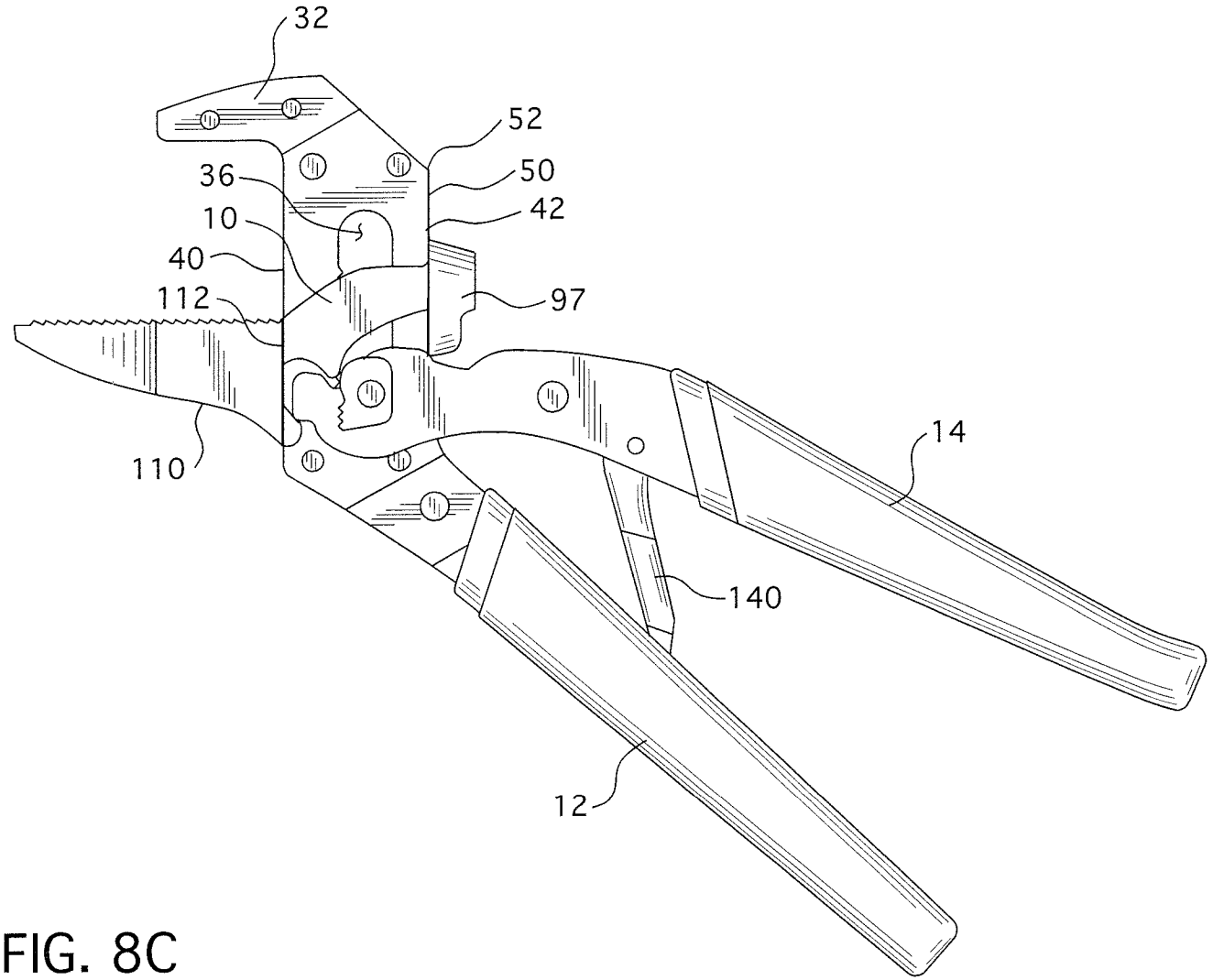

As noted above, both first plier member jaw assembly first removable jaw member 80 and second plier member jaw assembly 18 are removable. It is assumed, for this example, that neither the first plier member jaw assembly or first removable jaw member 80 second plier member jaw assembly 18 are initially installed. In this configuration, second plier member jaw assembly 18 may be installed as shown in FIGS. 8A-8C. As shown in FIG. 8A, second plier member jaw assembly 18 is positioned adjacent first plier member jaw assembly mount 32. Second plier member jaw assembly body medial portion 95 passes past first plier member jaw assembly mount 32 whereby the second plier member jaw assembly body jaw member guide members 110 are positioned adjacent first plier member jaw assembly elongated body upper guide surface 40, as shown in FIG. 8B. At this time, second plier member handle assembly first end plug 68 is positioned below second plier member jaw assembly body socket 94. When second plier member jaw assembly body medial portion 95 passes past first plier member jaw assembly mount 32 to the point where second plier member jaw assembly body at least one laterally offset guide member 96 is adjacent the first plier member jaw assembly elongated body lower guide surface 42, second plier member jaw assembly 18 is rotated thereby disposing second plier member jaw assembly body socket 94 over second plier member handle assembly first end plug 68, as shown in FIG. 8C. Further, the second plier member jaw assembly body jaw member guide member upper guide surface 112 is aligned with, and slidably engages, first plier member jaw assembly elongated body upper guide surface 40. Similarly, the second plier member jaw assembly body at least one laterally offset guide member lower guide surface 99 is, aligned with, and slidably engages first plier member jaw assembly elongated body lower guide surface 42.

In this configuration, the second plier member jaw assembly 18 moves between at least two positions, an open, first position, wherein said second plier member jaw assembly body at least one laterally offset guide member lower guide surface 99 slidably engages said first member jaw assembly at least one at least one guide surface use surface 50, and, a release position, wherein said second plier member jaw assembly body at least one laterally offset guide member lower guide surface 99 moves longitudinally beyond said first member jaw assembly at least one guide surface release end 52. That is, when the pliers 10 are in use, the second jaw assembly at least one laterally offset guide member guide surface 97 engages the first member jaw assembly at least one at least one guide surface use surface 50. If the user wishes to remove the second plier member jaw assembly 18, the user moves the second plier member jaw assembly body at least one laterally offset guide member lower guide surface 99 to the first member jaw assembly at least one guide surface release end 52 where it may be pivoted and removed by reversing the steps set forth above.

The second plier member jaw assembly 18 may be locked to the first plier member 12 by installing the first plier member jaw assembly first removable jaw member 80. That is, first plier member jaw assembly first removable jaw member 80 is coupled to the first plier member jaw assembly mount 32 as described above. In this configuration, first plier member jaw assembly first removable jaw member body lower mount portion offset body 87 lower surface is disposed adjacent to, and generally aligned with, the first member jaw assembly body lower guide surface first plier member jaw assembly elongated body lower guide surface 42. In this configuration, the first plier member jaw assembly first removable jaw member body lower mount portion offset body 87 lower surface effectively extends the length of the first plier member jaw assembly body lower guide surface 42. In this configuration, second plier member jaw assembly body at least one laterally offset guide member lower guide surface 99 may not move past the first removable jaw member body lower mount portion offset body 87 lower surface and the second plier member jaw assembly 18 may not pivot relative to first plier member 12. Thus, second plier member jaw assembly 18 may not be removed. First plier member jaw assembly first removable jaw member 80 may be selectively fixed in this position by installing fasteners 49. Removal of first plier member jaw assembly first removable jaw member 80 is accomplished by reversing the installation procedure.

Thus, pliers 10 may have a selected pair of jaws installed. That is, as noted above, first plier member jaw assembly first removable jaw member 80 and second plier member jaw assembly body jaw member 92 may have any shape. Thus, one set of jaws may be removed and another set of jaws, having a different shape for first plier member jaw assembly first removable jaw member 80 and second plier member jaw assembly body jaw member 92 may be installed.

Thus, the second plier member jaw assembly 18 may be selectively disposed in one of at least two configurations, a first configuration, wherein said second jaw assembly 18 is separated from said first member, and a second configuration, wherein said second plier member jaw assembly 18 is slidably coupled to said first plier member 12 with second plier member jaw assembly body socket 94 coupled to said second plier member handle assembly handle member first end 62 and said second plier member jaw assembly at least one guide member guide surface 97 slidably engaging the first plier member jaw assembly body at least one guide surface 38.

Figure 9:
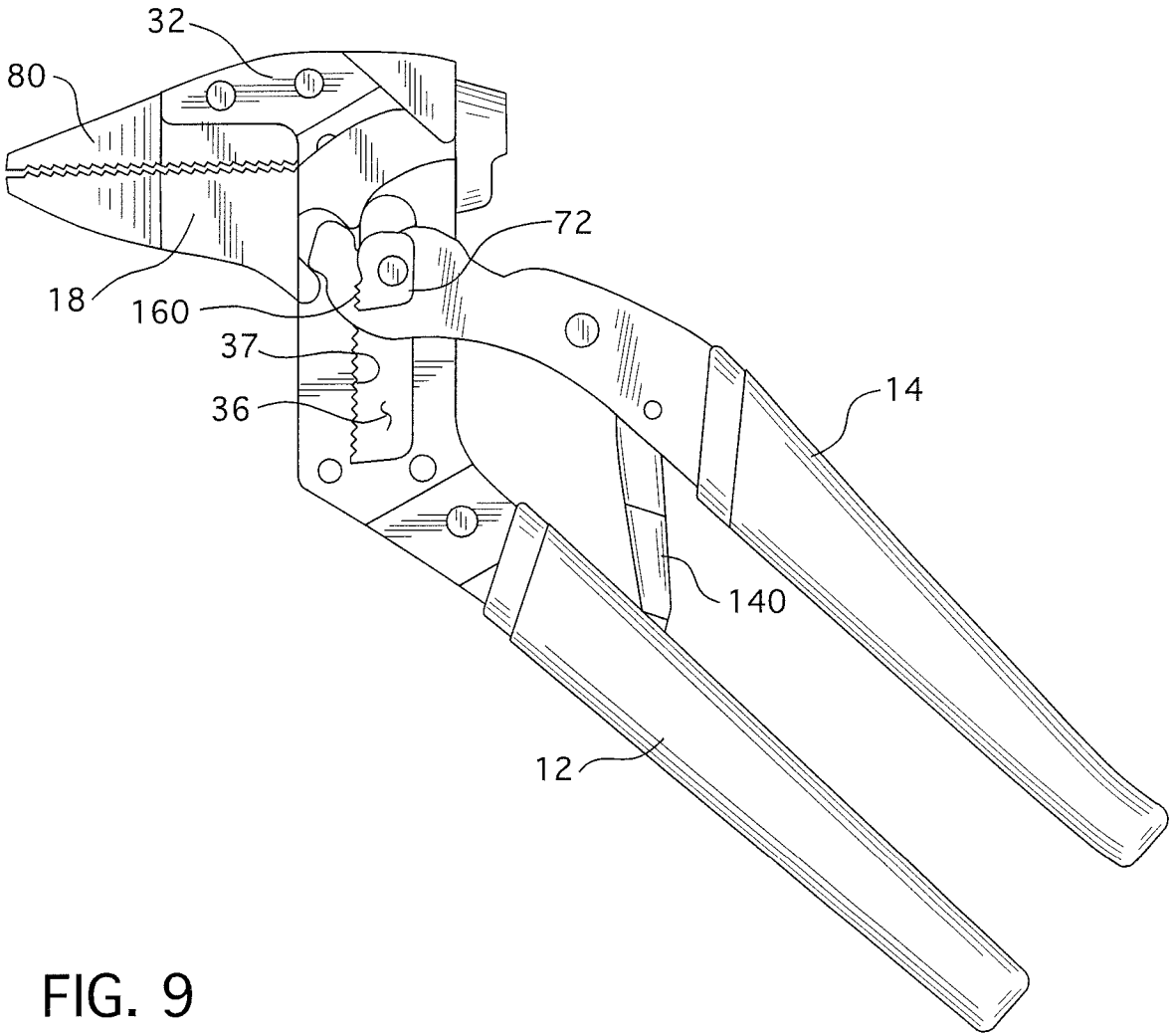
FIG. 9 is a side view of a pair of pliers.

Further, in this configuration, the second plier handle assembly handle member 60 moves between a first configuration (FIG. 3), wherein the second plier member handle assembly first end laterally offset extension pawl 72 does not engage the first member jaw assembly body slot upper rack 35 and wherein the second plier member handle assembly first end laterally offset extension pawl 72 slidably moves in the first plier member jaw assembly elongated body slot 34, and, a second configuration (FIG. 9), wherein the second plier member handle assembly first end laterally offset extension pawl 72 engages the first member jaw assembly body slot upper rack 35 creating a jaw pivot point 160 and wherein the second plier handle assembly handle member 60 pivots about said jaw pivot point 160.

That is, as the first and second plier handle members 20, 60 are squeezed together, first plier member jaw assembly 22 and second plier member jaw assembly 18 move together. At this time, second plier handle member 60 pivots, relative to first plier handle member 20, about the second plier member handle assembly linkage assembly pivot 144. When first plier member jaw assembly 22 and second plier member jaw assembly 18 engage a work piece 1, second plier handle assembly handle member 60 shifts upwardly causing second plier member handle assembly first end laterally offset extension pawl 72 to engage the first member jaw assembly body slot upper rack 35 creating a jaw pivot point 160.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A removable jaw member for a pair of pliers, said pair of pliers including a first plier member and a second plier member, said first plier member having a handle and a jaw assembly, said first plier member jaw assembly including an elongated body defining an elongated slot and having at least one guide surface, said first plier member jaw assembly at least one guide surface extending generally parallel to the longitudinal at axis of said first plier member jaw assembly body slot, said second plier member having a handle assembly, said second plier member handle assembly including a handle member having a first end, said second plier member handle assembly handle member pivotally coupled to said first plier member handle, said second plier member handle assembly handle member first end disposed adjacent said first plier member jaw assembly slot, said second plier member handle assembly handle member first end including a laterally offset extension extending into said first plier member jaw assembly slot, wherein said first plier member jaw assembly body at least one guide surface includes an upper guide surface and a lower guide surface, wherein said first plier member jaw assembly body lower guide surface includes a use surface and a release end, said removable jaw member comprising:

a second plier member jaw assembly including a body having a jaw member, a socket, and at least one laterally offset guide member having a guide surface;

wherein said second plier member jaw assembly is selectively disposed in one of at least two configurations, a first configuration, wherein said second plier member jaw assembly is separated from said first plier member, and a second configuration, wherein said second plier member jaw assembly is slidably coupled to said first plier member with said second plier member jaw assembly body socket coupled to said second plier member handle assembly handle member first end and said second plier member jaw assembly guide member at least one guide surface slidably engaging said first plier member jaw assembly body at least one guide surface;

said second plier member jaw assembly body at least one laterally offset guide member guide surface includes an upper guide member with a guide surface and a lower guide member with a guide surface;

said second plier member jaw assembly body upper guide member guide surface structured to slidably engage said first plier member jaw assembly body upper guide surface;

said second plier member jaw assembly body lower guide member guide surface structured to slidably engage said first plier member jaw assembly body lower guide surface; and when said second plier member jaw assembly is in said second configuration, said second plier member jaw assembly moves between at least two positions, an open, first position, wherein said second plier member jaw assembly lower guide member guide surface slidably engages said first plier member jaw assembly body lower guide surface use surface, and, a release position, wherein said second plier member jaw assembly lower guide member guide surface moves longitudinally beyond said first plier member jaw assembly body lower guide surface release end.

2. The removable jaw member of claim 1 wherein:

said second plier member jaw assembly body jaw member is elongated and has a longitudinal axis, said second plier member jaw assembly body jaw member having an upper, first end and a lower, second end;

said second plier member jaw assembly body includes an elongated medial portion having a longitudinal axis, said second plier member jaw assembly body medial portion having an upper, first end and a lower, second end;

said second plier member jaw assembly body medial portion coupled to said second plier member jaw assembly body jaw member, said second plier member jaw assembly body medial portion longitudinal axis disposed at an angle to said second plier member jaw assembly body jaw member longitudinal axis; and said second plier member jaw assembly body lower guide member coupled to said second plier member jaw assembly body medial portion second end.

3. The removable jaw member of claim 2 wherein said second plier member jaw portion upper guide member guide surface disposed on said second plier member jaw assembly body jaw member at least one laterally offset guide member.

4. The removable jaw member of claim 3 wherein said second plier member jaw assembly body socket is disposed at the lower end of said second plier member jaw assembly body jaw member.

5. A pair of pliers comprising:

a first plier member having a handle and a jaw assembly;

said first plier member jaw assembly including an elongated body defining an elongated slot and having at least one guide surface;

said first plier member jaw assembly at least one guide surface extending generally parallel to the longitudinal axis of said first plier member jaw assembly body slot;

a second plier member having a handle assembly and a jaw assembly;

said second plier member handle assembly including a handle member having a first end, said second plier member handle assembly handle member pivotally coupled to said first plier member handle, said second plier member handle assembly handle member first end disposed adjacent said first plier member jaw assembly slot;

said second plier member handle assembly handle member first end including a laterally offset extension extending into said first plier member jaw assembly slot;

said second plier member jaw assembly including a body having a jaw member, a socket, and at least one laterally offset guide member having a guide surface;

wherein said second plier member jaw assembly is selectively disposed in one of at least two configurations, a first configuration, wherein said second plier member jaw assembly is separated from said first plier member, and a second configuration, wherein said second plier member jaw assembly is slidably coupled to said first plier member with said second plier member jaw assembly body socket coupled to said second plier member handle assembly handle member first end and said second plier member jaw assembly guide member at least one guide surface slidably engaging said first plier member jaw assembly body at least one guide surface;

said first plier member jaw assembly body at least one guide surface includes an upper guide surface and a lower guide surface;

said second plier member jaw assembly body at least one laterally offset guide member guide surface includes an upper guide member with a guide surface and a lower guide member with a guide surface;

said second plier member jaw assembly body upper guide member guide surface structured to slidably engage said first plier member jaw assembly body upper guide surface;

said second plier member jaw assembly body lower guide member guide surface structured to slidably engage said first plier member jaw assembly body lower guide surface;

said first plier member jaw assembly body lower guide surface includes a use surface and a release end; and wherein, when said second plier member jaw assembly is in said second configuration, said second plier member jaw assembly moves between at least two positions, an open, first position, wherein said second plier member jaw assembly lower guide member guide surface slidably engages said first plier member jaw assembly body lower guide surface use surface, and, a release position, wherein said second plier member jaw assembly lower guide member guide surface moves longitudinally beyond said first plier member jaw assembly body lower guide surface release end.

6. The pliers of claim 5 wherein:

said second plier member jaw assembly body jaw member is elongated and has a longitudinal axis, said second plier member jaw assembly body jaw member having an upper, first end and a lower, second end;

said second plier member jaw assembly body includes an elongated medial portion having a longitudinal axis, said second plier member jaw assembly body medial portion having an upper, first end and a lower, second end;

said second plier member jaw assembly body medial portion coupled to said second plier member jaw assembly body jaw member, said second plier member jaw assembly body medial portion longitudinal axis disposed at an angle to said second plier member jaw assembly body jaw member longitudinal axis; and said second plier member jaw assembly body lower guide member coupled to said second plier member jaw assembly body medial portion second end.

7. The pliers of claim 6 wherein said second plier member jaw portion upper guide member guide surface disposed on said second plier member jaw assembly body jaw member at least one laterally offset guide member.

8. The pliers of claim 7 wherein said second plier member jaw assembly body socket is disposed at the lower end of said second plier member jaw assembly body jaw member.

9. The pliers of claim 6 wherein:

said first plier member jaw assembly includes a mount and a first removable jaw member; and wherein said first plier member jaw assembly first removable jaw member is selectively disposed in one of two configurations, a first configuration, wherein said first plier member jaw assembly first removable jaw member is separated from said first plier member, and a second configuration, wherein said first plier member jaw assembly first removable jaw member is coupled to said first plier member jaw assembly mount.

10. The pliers of claim 9 wherein:

said first plier member jaw assembly first removable jaw member includes a laterally offset body, said first plier member jaw assembly first removable jaw member laterally offset body having a lower surface;

when said first plier member jaw assembly first removable jaw member is in said second configuration, said first plier member jaw assembly first removable jaw member laterally offset body lower surface is disposed adjacent to, and generally aligned with, said first plier member jaw assembly body lower guide surface; and wherein, when said second plier member jaw assembly is in said second configuration, said second plier member jaw assembly moves between at least two positions, an open, first position, wherein said second plier member jaw assembly lower guide member guide surface slidably engages said first plier member jaw assembly body lower guide surface use surface, and, a second, closed position, wherein said second plier member jaw assembly lower guide member guide surface slidably engages said first plier member jaw assembly body lower guide surface.

11. The pliers of claim 10 wherein first plier member jaw assembly includes a releasable locking assembly structured to selectively couple said first plier member jaw assembly first removable jaw member and said first plier member jaw assembly mount.

12. The pliers of claim 11 wherein:

said first plier member jaw assembly releasable locking assembly includes a ball and a detent;

said ball laterally extending from said first plier member jaw assembly first removable jaw member; and said first plier member jaw assembly mount including a detent.

13. The pliers of claim 12 wherein:

said first plier member jaw assembly releasable locking assembly further includes a pivoting clip assembly having a body with two generally parallel arms;

said pivoting clip assembly body rotatably coupled to said first plier member jaw assembly first removable jaw member; and wherein said pivoting clip assembly body is structured to move between two positions, a first position, wherein said pivoting clip arms are not disposed over first plier member jaw assembly mount, and, a second position, wherein pivoting clip arms are disposed over first plier member jaw assembly mount.

14. The pliers of claim 5 wherein:

said first plier member jaw assembly body slot includes an upper surface, said first plier member jaw assembly body slot upper surface including a rack;

said second plier member handle assembly handle member first end laterally offset extension including a pawl;

said second plier member handle assembly handle member first end laterally offset extension pawl is structured to engage said first plier member jaw assembly body slot upper surface rack and create a jaw pivot point;

said second plier member handle assembly handle member first end laterally offset extension pawl disposed in said first plier member jaw assembly body slot; and wherein said second plier handle assembly handle member moves between a first configuration, wherein said second plier member handle assembly handle member first end laterally offset extension pawl does not engage said first member jaw assembly body slot upper surface teeth and wherein said second plier member handle assembly handle member first end laterally offset extension pawl slidably moves in said first plier member jaw assembly body slot, and, a second configuration, wherein said second plier member handle assembly handle member first end laterally offset extension pawl engages said first plier member jaw assembly body slot rack creating a jaw pivot point and wherein said second plier member handle assembly handle member pivots about said jaw pivot point.

15. A pair of pliers comprising:

a first having a handle and a jaw assembly;

said first plier member jaw assembly including an elongated body defining an elongated slot and having at least one guide surface;

said first plier member jaw assembly at least one guide surface extending generally parallel to the longitudinal axis of said member jaw assembly body slot;

a second plier member having a handle assembly and a jaw assembly;

said second plier member handle assembly including a handle member having a first end, said second plier member handle assembly handle member pivotally coupled to said first plier member handle, said second plier member handle assembly handle member first end disposed adjacent said first plier member jaw assembly slot;

said second plier member handle assembly handle member first end including a laterally offset extension extending into said first plier member jaw assembly slot;

a second plier member jaw assembly including a body having a jaw member, a socket, and at least one laterally offset guide member having a guide surface;

wherein said second plier member jaw assembly is selectively disposed in one of at least two configurations, a first configuration, wherein said second plier member jaw assembly is separated from said first plier member, and a second configuration, wherein said second plier member jaw assembly is slidably coupled to said first plier member with said second plier member jaw assembly body socket coupled to said second plier member handle assembly handle member first end and said second plier member jaw assembly guide member at least one guide surface slidably engaging said first plier member jaw assembly body at least one ride surface;

said first plier member jaw assembly body at least one guide surface includes an upper guide surface and a lower guide surface;

said second plier member jaw assembly body at least one laterally offset guide member guide surface includes an upper guide member with a guide surface and a lower guide member with a guide surface;

said second plier member jaw assembly body upper guide member guide surface structured to slidably engage said first plier member jaw assembly body upper guide surface;

said second plier member jaw assembly body lower guide member guide surface structured to slidably engage said first plier member jaw assembly body lower guide surface;

said first plier member jaw assembly body at least one at least one guide surface includes a use surface and a release end; and wherein, when said second plier member jaw assembly is in said second configuration, said second plier member jaw assembly moves between at least two positions, an open, first position, wherein said second plier member jaw assembly lower guide member guide surface slidably engages said first plier member jaw assembly body lower guide surface use surface, and, a release position, wherein said second plier member jaw assembly lower guide member guide surface moves longitudinally beyond said first plier member jaw assembly body lower guide surface release end.

16. The pliers of claim 15 wherein:

said second plier member jaw assembly body jaw member is elongated and has a longitudinal axis, said second plier member jaw assembly body jaw member having an upper, first end and a lower, second end;

said second plier member jaw assembly body includes an elongated medial portion having a longitudinal axis, said second plier member jaw assembly body medial portion having an upper, first end and a lower, second end;

said second plier member jaw assembly body medial portion coupled to said second plier member jaw assembly body jaw member, said second plier member jaw assembly body medial portion longitudinal axis disposed at an angle to said second plier member jaw assembly body jaw member longitudinal axis; and said second plier member jaw assembly body lower guide member coupled to said second plier member jaw assembly body medial portion second end.

17. The pliers of claim 16 wherein:

said first plier member jaw assembly includes a mount and a first removable jaw member; and wherein said first plier member jaw assembly first removable jaw member is selectively disposed in one of two configurations, a first configuration, wherein said first plier member jaw assembly first removable jaw member is separated from said first plier member, and a second configuration, wherein said first plier member jaw assembly first removable jaw member is coupled to said first plier member jaw assembly mount.

18. The pliers of claim 17 wherein:

said first plier member jaw assembly first removable jaw member includes a laterally offset body, said first plier member jaw assembly first removable jaw member laterally offset body having a lower surface;

when said first plier member jaw assembly first removable jaw member is in said second configuration, said first plier member jaw assembly first removable jaw member laterally offset body lower surface is disposed adjacent to, and generally aligned with, said first plier member jaw assembly body tower guide surface; and wherein, when said second plier member jaw assembly is in said second configuration, said second plier member jaw assembly moves between at least two positions, an open, first position, wherein said second plier member jaw assembly tower guide member guide surface slidably engages said first plier member jaw assembly body lower guide surface use surface, and, a second, closed position, wherein said second plier member jaw assembly lower guide member guide surface slidably engages said first plier member jaw assembly body lower guide surface.

* * * * *

UNITED STATES PATENT AND TRADEMARK OFFICE

CERTIFICATE OF CORRECTION

PATENT NO. : 9,003,931 B2
APPLICATION NO. : 13/629830
DATED : April 14, 2015
INVENTOR(S) : Charles M. Phillips, Sr. et al.

It is certified that error appears in the above-identified patent and that said Letters Patent is hereby corrected as shown below:

IN THE CLAIMS

Column 15, line 36, Claim 1, “at axis” should read --axis--.
Column 19, line 31, Claim 15, “a first having” should read --a first plier member having--.
Column 19, line 37, Claim 15, “said member” should read --said first plier member--.
Column 19, line 64, Claim 15, “ride” should read --guide--.
Column 20, line 67, Claim 18, “tower” should read --lower--.
Column 21, line 5, Claim 18, “tower” should read --lower--.

Signed and Sealed this
Twenty-seventh Day of October, 2015

Michelle K. Lee

Michelle K. Lee
*Director of the United States Patent and Trademark Office*